US008664498B2

(12) United States Patent
Leneman

(10) Patent No.: US 8,664,498 B2
(45) Date of Patent: Mar. 4, 2014

(54) GUITAR PICK

(76) Inventor: Michael Leneman, Los Angeles, CA (US)

( * ) Notice: Subject to any disclaimer, the term of this patent is extended or adjusted under 35 U.S.C. 154(b) by 55 days.

(21) Appl. No.: 13/445,425

(22) Filed: Apr. 12, 2012

(65) Prior Publication Data

US 2012/0260788 A1 Oct. 18, 2012

Related U.S. Application Data

(60) Provisional application No. 61/475,052, filed on Apr. 13, 2011.

(51) Int. Cl.
*G10D 3/16* (2006.01)

(52) U.S. Cl.
USPC ..... 84/322

(58) Field of Classification Search
USPC ..... 84/322
See application file for complete search history.

(56) References Cited

U.S. PATENT DOCUMENTS

| | | | | | |
|---|---|---|---|---|---|
| 566,806 | A | * | 9/1896 | Shearer | 84/322 |
| 756,348 | A | * | 4/1904 | Forney | 84/322 |
| 1,444,982 | A | * | 2/1923 | Orth | 84/322 |
| 1,547,560 | A | * | 7/1925 | Burdwise | 84/322 |
| 3,735,663 | A | * | 5/1973 | Cowell, Sr. | 84/322 |
| 4,020,732 | A | | 5/1977 | Kelly | |
| 4,347,773 | A | * | 9/1982 | Zook | 84/322 |
| 4,497,237 | A | * | 2/1985 | Beall | 84/322 |
| 4,625,615 | A | * | 12/1986 | Lukehart | D17/20 |
| D291,809 | S | * | 9/1987 | Jasper | 84/322 |
| 5,509,341 | A | * | 4/1996 | Dunlop | 84/322 |
| D392,668 | S | * | 3/1998 | Shingler | D17/20 |
| 5,864,075 | A | * | 1/1999 | Mapson | 84/322 |
| 5,981,857 | A | * | 11/1999 | Mapson | 84/322 |
| 6,335,477 | B1 | * | 1/2002 | Miller | 84/322 |
| D603,449 | S | * | 11/2009 | Whetstine | D17/20 |
| D603,891 | S | * | 11/2009 | Whetstine | D17/20 |
| D607,920 | S | | 1/2010 | Bartel | |
| 7,718,874 | B2 | | 5/2010 | Cheok | |
| 7,786,362 | B1 | * | 8/2010 | Whetstine | 84/320 |
| 2006/0086231 | A1 | * | 4/2006 | Sielaff | 84/322 |
| 2012/0137852 | A1 | | 6/2012 | Culver et al. | |
| 2012/0260788 | A1 | * | 10/2012 | Leneman | 84/322 |

FOREIGN PATENT DOCUMENTS

DE 3120597 A1 12/1982

* cited by examiner

*Primary Examiner* — Robert W Horn
(74) *Attorney, Agent, or Firm* — Kelly & Kelley, LLP

(57) ABSTRACT

A hand-held guitar pick includes a distal end which is twisted at a compound angle with respect to the body of the pick so as to align the tip of the pick with the guitar strings. The compound angle comprises a rotation component in relation to a longitudinal axis and a bent component in relation to a lateral axis. The bend and rotation properly align the distal end of the hand-held pick to better engage a string on a guitar when used in a typical manner. One embodiment resembles a traditional triangular pick. Another embodiment includes a cylindrical, hollow body configured to be worn over a user's fingertip. The distal end comprises an arced bridge spanning edges of the cylindrical body.

22 Claims, 6 Drawing Sheets

GUITAR PICK

FIELD OF THE INVENTION

The present invention generally relates to guitar picks. More particularly, the present invention relates to a guitar pick with a bent and rotated distal end.

BACKGROUND OF THE INVENTION

A plectrum is a small flat tool used to pluck or strum a stringed instrument. For hand-held instruments such as guitars and mandolins, the plectrum is often called a pick, and is a separate tool held in the player's hand. In harpsichords, the plectra are attached to the jack mechanism. A plectrum (pick) for electric guitars, acoustic guitars, bass guitars and mandolins is typically a thin piece of plastic or other material shaped like a pointed teardrop or triangle. The size, shape and width may vary considerably. Thin items such as small coins, bread clips or broken compact discs and credit cards can be used as substitute plectra. Banjo and guitar players may wear a metal or plastic thumb pick mounted on a ring, and bluegrass banjo players often wear metal or plastic fingerpicks on their fingertips. Guitarists also use fingerpicks.

Guitar picks are made of a variety of materials, including celluloid, metal, and rarely other exotic materials such as turtle shell, but today delrin is the most common material. For other instruments in the modern day most players use plastic plectra but a variety of other materials, including wood and felt (for use with the ukulele) are common. Guitarists in the rock, blues, jazz and bluegrass genres tend to use a plectrum, partly because the use of steel strings tends to wear out the fingernails quickly, and also because a plectrum provides a more 'focused' and 'aggressive' sound. Many guitarists also use the pick and the remaining right-hand fingers simultaneously to combine some advantages of flat picking and finger picking. This technique is called hybrid picking.

Playing a guitar with a pick produces a bright sound compared to plucking with the fingertip. Picks also offer a greater contrast in tone across different plucking locations. For example, the difference in brightness between plucking close to the bridge and close to the neck is much greater when using a pick compared to a fingertip. Conversely, the many playing techniques that involve the fingers, such as those found in fingerstyle guitar, slapping, classical guitar, and flamenco guitar, can also yield an extremely broad variety of tones.

Guitar picks vary in thickness to accommodate different playing styles and kinds of strings. Thinner picks are more flexible and tend to offer a wider range of sounds, from soft to loud, and produce a "click" that emphasizes the attack of the picking. However, heavier picks usually produce a brighter tone. In rock and heavy metal, while playing electric guitar with hi-gain amplification or distortion, thinner picks produce muddier, heavier, less controllable sound and thicker picks produce more delicate, more controlled and well-shaped tone. Thinner picks also tend to rip or tear more often if used too forcefully, whereas a thicker one is less likely to wear down. Thicker picks are generally used in more discrete genres, such as heavy metal or power metal. However, there are many exceptions to these stereotypes, especially as there is an element of guitarist preference involved in selecting pick thickness.

Many death metal musicians only use picks thicker than 1.5 mm, because it allows more control over heavy gauge strings. Thinner picks tend to give less attack and do not give as much control when doing fast tremolo picking. Also, they tend to wear much faster when used with heavier gauge strings. Jazz guitar players tend to use quite heavy picks, as they also tend to favor heavy gauge flat-wound strings. Bass players tend to prefer thick picks because their strings are far thicker and farther apart than those of guitarists.

With all the variations in pick designs over the years, the basic design of flat pick has remained the same. The guitarist typically holds the pick in his right hand between the thumb and index finger while he plucks the string. Due to the orientation of the guitar relative the plucking hand, the distal end of the pick which actually engages with the string is not aligned. It would be unnatural and uncomfortable for the guitarist to contort his hand such that the distal end of the pick is then aligned with the string. This means that the distal end of the pick actually engages the string at an angle. Engaging with the string at an angle can produce a different noise or sound as compared to engaging the string in alignment.

Accordingly, there is a need for a guitar pick that engages the string in alignment. The present invention fulfills these needs and provides other related advantages.

SUMMARY OF THE INVENTION

The present invention is directed to a pick for a musical instrument having strings. The pick has a body with a tip at one end—the tip designed to engage and pluck the strings. The tip is oriented at a compound angle with respect to the body such that the compound angle aligns the tip with the strings when the pick is used on the musical instrument. The compound angle includes a rotation angle measured between the tip and a longitudinal axis of the body, and a bend angle measured between the tip and a lateral axis of the body. Preferably, the rotation angle measures from zero to ninety degrees and the bend angle measures from zero to ninety degrees, keeping in mind that the rotation angle and the bend angle are not both zero degrees.

The body preferably has a proximal end and a distal end, wherein the tip is disposed on the distal end and the proximal end is configured to be grasped by a user. In one embodiment, the body has a flat, generally triangular-shape configured to be grasped by a user. In another embodiment, the body has a hollow, cylindrical shape that is configured to fit over a fingertip of a user. In this later embodiment, the body includes a flex-relief cut-away to allow the hollow cylinder to expand to accommodate fingertips of different sizes. In addition, the proximal end includes a knuckle relief cut-away so as to avoid interference with or rubbing on the first knuckle of the fingertip. Also in this later embodiment, the distal end has a bridge configured as a partial-ring spanning two-edge portions of the hollow, cylindrical body. The tip is disposed at the peak of this bridge.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
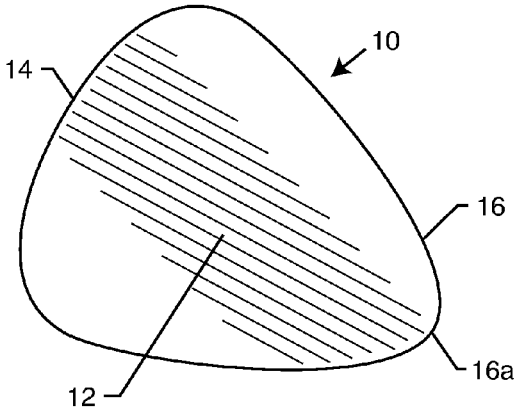
FIG. 1 PRIOR ART
FIG. 1 is a front view of a prior art guitar pick.
Figure 2:
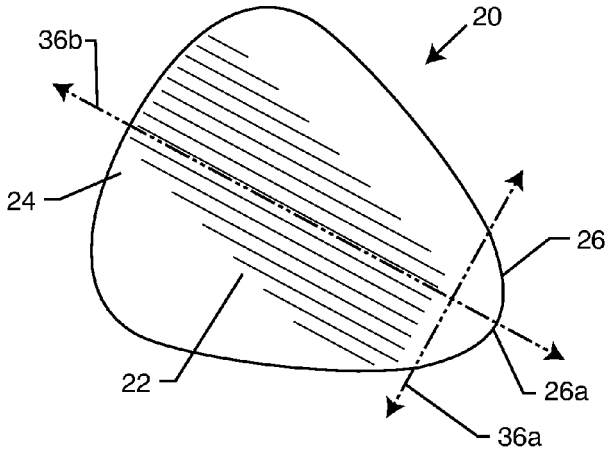
FIG. 2 is a front view of an exemplary guitar pick illustrating the design of the present invention.
Figure 3:
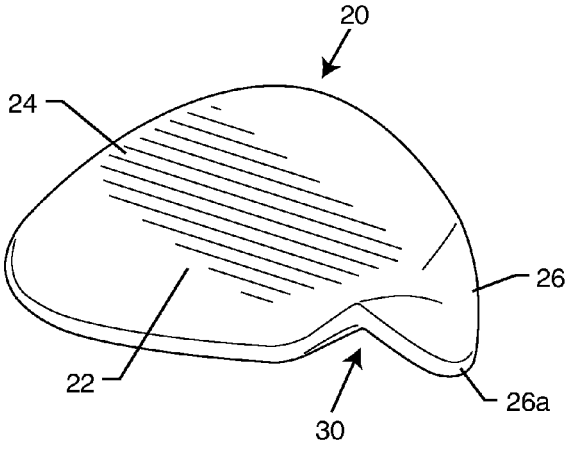
FIG. 3 is a perspective view of the structure of an exemplary guitar pick of the present invention.

FIG. 1 shows a front view of a prior art guitar pick 10. The pick 10 shown here is generally triangular in shape with rounded corners. Other shapes are possible by one skilled in the art and this disclosure is not meant to be limited to just the precise forms described herein. The pick 10 has a body 12, with a proximal end 14 that is usually held between the thumb and fingers of the guitar player and a distal end 16 having a tip 16*a* that engages the strings of the guitar.

Figure 4:
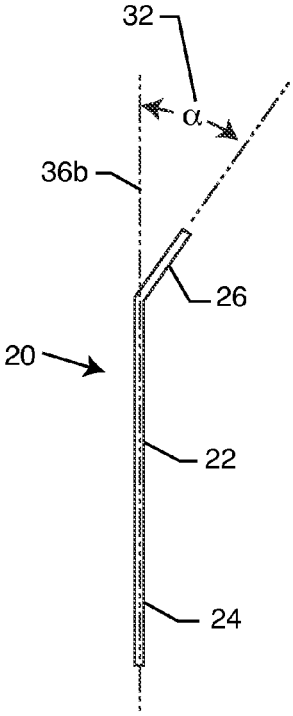
FIG. 4 is a side view of an exemplary guitar pick of the present invention.
Figure 5:
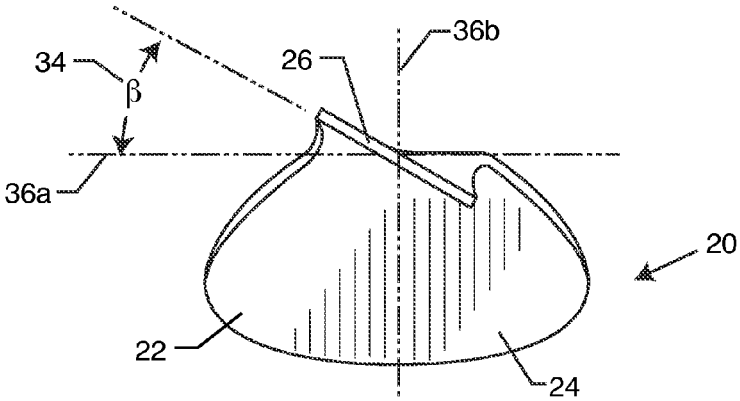
FIG. 5 is an elevated front view of an exemplary guitar pick of the present invention.

FIGS. 2-5 show an exemplary guitar pick 20 embodying the present invention. This embodiment still has a body 22 with a proximal end 24 and a distal end 26 having a tip 26*a*. However, the distal end 26 has been rotated and bent as indicated. As illustrated in FIGS. 4 and 5, rotation and bending of the distal end 26 results in a compound angle 30 having a bend component (α) 32 such that the distal end is bent around a lateral axis 36*a* and a rotation component (β) 34 such that the distal end is rotated about a longitudinal axis 36*b*. In this embodiment, the lateral axis 36*a* and the longitudinal axis 36*b* are orthogonal to one another and form a plane in-line with the body 22.

The compound angle 30 may typically have a bend component 32 of about thirty degrees. However, bend components 32 of other angles from zero to ninety degrees are possible. For instance, some guitar players may prefer the bend component 30 to be fifteen, thirty or forty-five degrees. The rotation component 34 may also typically be about thirty degrees. However, rotation components 34 of other angles from zero to ninety degrees are possible. For instance, some guitar players may also prefer the rotation component 34 to be fifteen, thirty or forty-five degrees. Various combinations of angle measurements for the bend 32 and rotation 34 components are possible. It is not necessary that the bend 32 and rotation 34 components have the same angle measurement.

The bend 32 and rotation 34 components essentially result in a twisting movement of the distal end 26 relative to the body 22 of the pick. It is to be understood by one skilled in the art that either movement may be described as a bend or a rotation and that either can be performed with or without the other, i.e., zero degrees of bend or rotation. Also, the order of performing either a bend or rotation may be varied.

Figure 6:
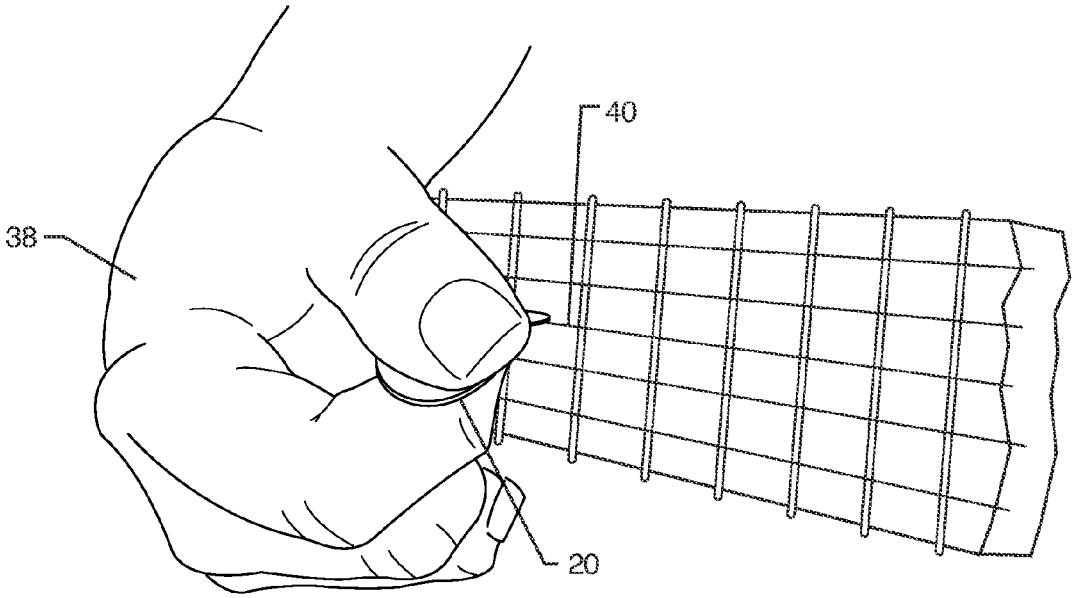
FIG. 6 is an environmental view of the structure of FIG. 3 illustrating the guitar pick in use.

FIG. 6 shows an environmental view illustrating the pick 20 in use. The proximal end 24 of the pick 20 is typically held between the thumb and fingers of the hand 38 of the guitar player. When the prior art pick 10 is held it is natural for the distal end 16 to have an angled alignment with respect to the strings 40. The compound angle 30 of the inventive pick 20 places the tip 26*a* of the distal end 26 in generally parallel alignment with the strings 40. The guitar player is now able to contact the string 40 more completely using more surface area of the tip 26*a*, i.e., in a more direct manner, resulting in a range of musical benefits.

Such musical benefits can include a better tone through a reduction in pick noise. Furthermore, the inventive pick 20 is able to achieve more efficient contact with the strings 40 which helps the musician increase accuracy.

Figure 7:
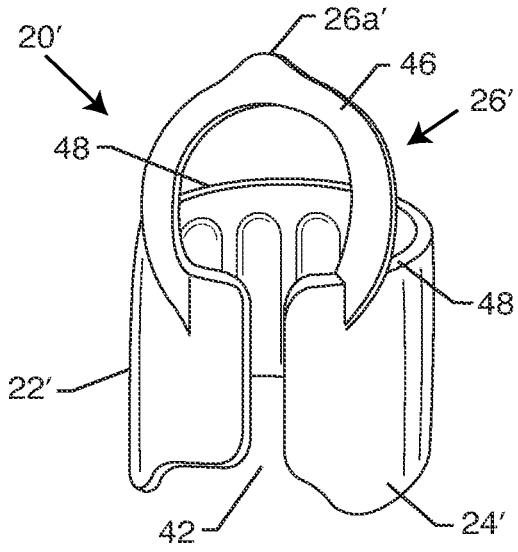
FIG. 7 is a front view of an exemplary guitar pick of an alternate embodiment of the present invention.
Figure 8:
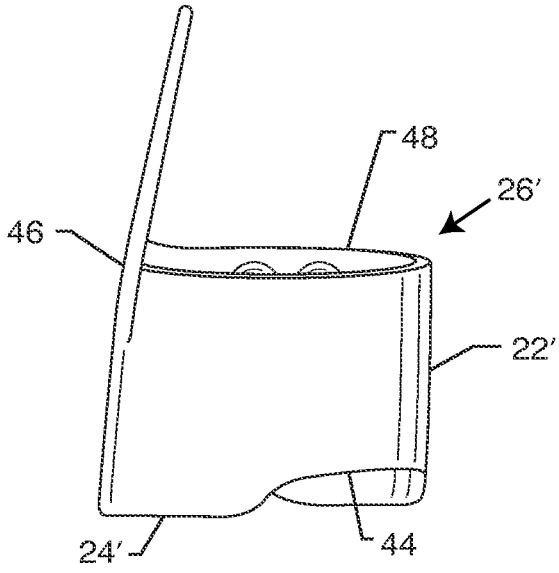
FIG. 8 is a side view of the guitar pick of FIG. 7.
Figure 9:
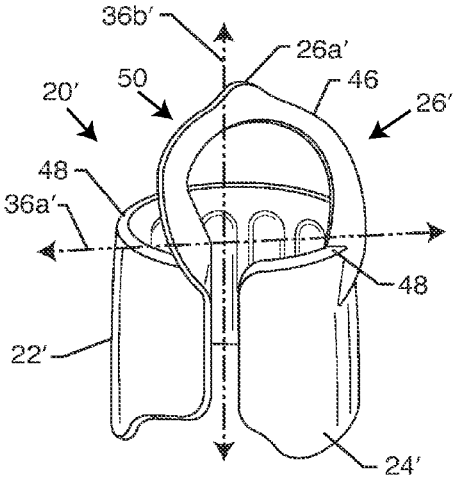
FIG. 9 is a front view of an exemplary guitar pick of another alternate embodiment of the present invention.

FIGS. 7-8 show another exemplary guitar pick 20' embodying the present invention, where the pick 20' is now designed to be placed over a fingertip. FIG. 7 shows a front view of pick 20' and FIG. 8 shows a side view of the structure of FIG. 7. The pick 20' has a hollow, cylindrical body 22' having a proximal end 24' and a distal end 26'. The hollow cylindrical body 22' is configured to be placed over the fingertip of a user, as described more fully below.

The hollow, cylindrical body 22' may include a flex-relief cut-away or gap 42, which allows the body 22' to accommodate fingertips of different sizes. The proximal end 24' includes a knuckle-relief cut-away 44 to accommodate the first knuckle of a user's fingertip that may protrude when bending the finger. Preferably, the gap 42 is centered so as to accommodate the fingerprint area of a fingertip and is narrowed so as to minimize excessive widening of the body 22'. In addition, the knuckle-relief cut-away 44 is preferably centered on the back of the fingertip, but may be shifted to accommodate users with crooked knuckles.

The distal end 26' includes a distal loop or bridge 46, which is configured as an arc or partial ring. The ends of the bridge 46 are connected to distal edges 48 of the body 22'. The bridge 46 is preferably centered over the gap 42 although it may be shifted left or right to accommodate varying finger shapes. The ends of the loop or bridge 46 may be attached to the distal edges 48 along a front face of the body 22'. Alternatively, the span of the loop or bridge 46 may be wider such that the ends are attached to distal edges 48 of the body 22' across a mid-section or at its widest point (not shown).

Figure 10:
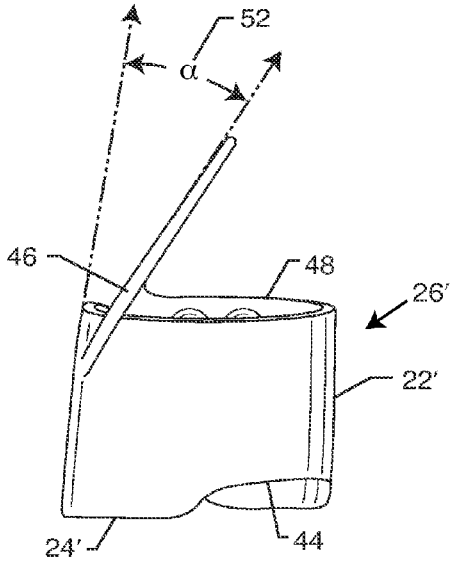
FIG. 10 is a side view of the guitar pick of FIG. 9.
Figure 11:
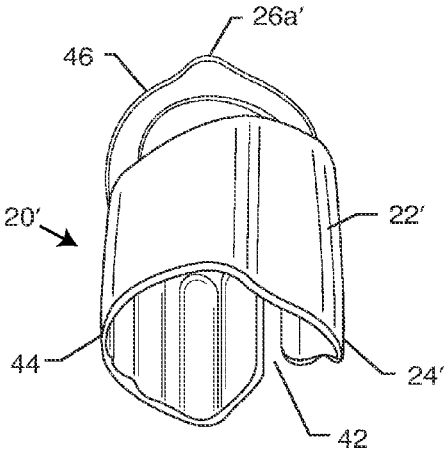
FIG. 11 is a lower-rear perspective view of the guitar pick of FIG. 9.
Figure 12:
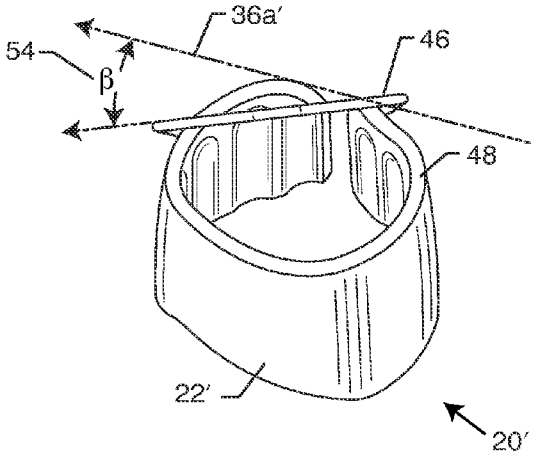
FIG. 12 is an upper-rear perspective view of the guitar pick of FIG. 9.

FIGS. 9-12 show another exemplary guitar pick 20' embodying the present invention. The guitar pick of FIGS. 9-12 is similar to the guitar pick of FIGS. 7-8. In this embodiment, the bridge 46 is connected at a compound angle 50 in relation to the orientation of the bridge 46 illustrated in FIGS. 7 and 8. The compound angle 50 has a bend component (α) 52 and a rotation component (β) 54 as illustrated in FIGS. 10 and 12. The bend component 52 has the bridge 46 bent around a lateral axis 36*a'* and the rotation component 54 has the bridge 46 rotated around a longitudinal axis 36*b'*. In this embodiment, the lateral axis 36*a'* is oriented across the top or distal edges 48 of the body 22' and the longitudinal axis 36*b'* is oriented through the center of the hollow, cylindrical body 22'—orthogonally to the lateral axis 36*a'*—as illustrated in FIGS. 9-12. Distinct from the earlier embodiment, the lateral axis 36*a'* and the longitudinal axis 36*b'* do not intersect or form a plane.

Similar limitations regarding the measurements of the bend component 52 and the rotation component 54, as discussed above in connection with the earlier embodiment are applicable herein. As with the earlier embodiment, the bend 52 and rotation 54 components essentially result in a twisting movement of the distal end 26' or bridge 46 relative to the body 22' of the pick 20'. It is to be understood by one skilled in the art that either movement may be described as a bend or a rotation and that either can be performed with or without the other, i.e., zero degrees of bend or rotation. Also, the order of performing either a bend or rotation may be varied.

Figure 13:
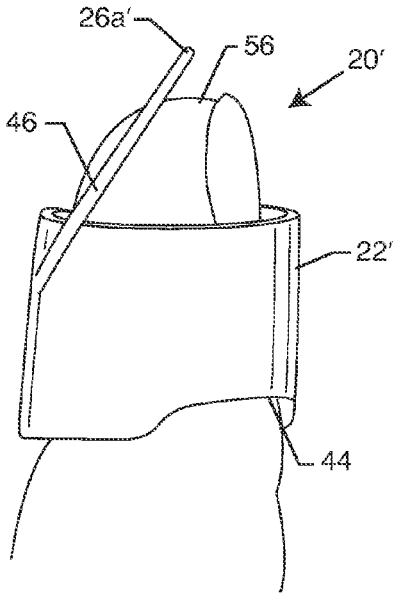
FIG. 13 is an environmental view of the structure of FIGS. 9-12 illustrating the guitar pick on a finger.
Figure 14:
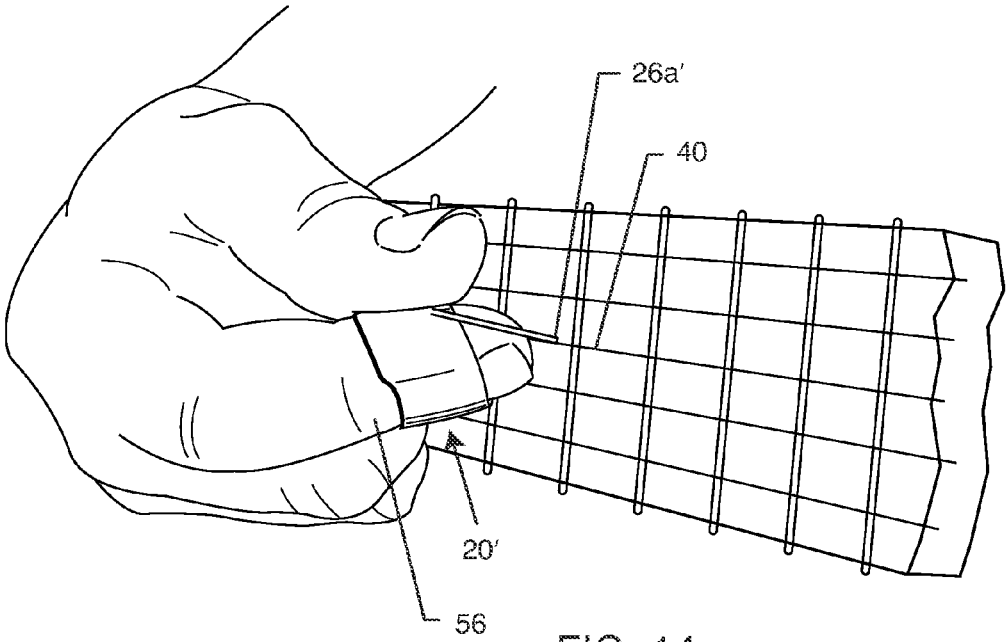
FIG. 14 is an environmental view of the structure of FIGS. 9-12 illustrating the guitar pick in use.

FIG. 13 shows an environmental view of the pick 20' of FIGS. 9-12 on a fingertip 56. FIG. 14 shows an environmental view of the pick 20' of FIGS. 9-12, now illustrating the guitar pick 20' in use with strings 40 of a guitar. The pick 20' is held upon the fingertip 56 of the guitar player. When the prior art version of this pick was held, it was natural for the tip to be angled with respect to the alignment of the strings 40. In the inventive pick 20', the compound angle 50 of the bridge 46 with respect to the body 22', results in the tip **26*a*' being in alignment with or parallel to the strings 40. The guitar player is now able to contact the string 40 more completely using more surface area of the tip 26*a*'**, i.e., in a more direct manner, resulting in a range of musical benefits as earlier discussed.

The embodiments shown herein are configured for a right-handed guitar player. It is to be understood that the teachings of this disclosure can be applied to a left-handed guitar player just as well.

Although several embodiments have been described in detail for purposes of illustration, various modifications may be made without departing from the scope and spirit of the invention. Accordingly, the invention is not to be limited, except as by the appended claims.

What is claimed is:

1. A pick for a musical instrument having strings, comprising:

a body having a tip at one end, wherein the tip is oriented at a compound angle with respect to the body to align the tip with the strings when the pick is used on the musical instrument, wherein the compound angle comprises a bend angle wherein the tip is bent about a lateral axis of the body, such that the tip is outside of a plane defined in-line with the body.

2. The pick of claim 1, the body comprising a proximal end and a distal end, wherein the tip is disposed on the distal end and the proximal end is configured to be grasped by a user.

3. The pick of claim 1, wherein the body comprises a flat, generally triangular-shaped body configured to be grasped by a user.

4. The pick of claim 1, wherein the compound angle further comprises a rotation angle, wherein the tip is rotated about a longitudinal axis of the body, said longitudinal axis being orthogonal to the lateral axis and defining the plane in-line with the body.

5. The pick of claim 4, wherein the rotation angle measures from zero to ninety degrees and the bend angle is greater than zero degrees and less than or equal to ninety degrees.

6. The pick of claim 1, wherein the body comprises a hollow, cylindrical body configured to fit over a fingertip of a user.

7. The pick of claim 6, wherein the body comprises a flex-relief cut-away and a proximal end of the body comprises a knuckle relief cut-away.

8. The pick of claim 6, wherein distal end of the body comprises a bridge configured as a partial-ring attached to edge portions along a front face of the hollow, cylindrical body.

9. The pick of claim 8, wherein the tip is disposed at a peak of the bridge.

10. A pick for a musical instrument having strings, comprising:

a body having a proximal end and a distal end, wherein the distal end is oriented at a compound angle with respect to the body, wherein the compound angle comprises a bend angle wherein the distal end is bent about a lateral axis of the body such that the distal end is outside of a plane defined in-line with the body; and a tip disposed on the distal end, wherein the compound angle is configured to align the tip with the strings when the pick is used on the musical instrument.

11. The pick of claim 10, wherein the body comprises a flat, generally triangular-shaped body, and wherein the proximal end is configured to be grasped by a user.

12. The pick of claim 10, wherein the compound angle further comprises a rotation angle, wherein the tip is rotated about a longitudinal axis of the body, said longitudinal axis being orthogonal to the lateral axis and defining the plane in-line with the body.

13. The pick of claim 12, wherein the rotation angle measures from zero to ninety degrees and the bend angle is greater than zero degrees and less than or equal to ninety degrees.

14. The pick of claim 10, wherein the body comprises a hollow, cylindrical body configured to fit over a fingertip of a user.

15. The pick of claim 14, wherein the body comprises a flex-relief cut-away and the proximal end comprises a knuckle relief cut-away.

16. The pick of claim 14, wherein the distal end comprises a bridge configured as a partial-ring attached to edge portions of the hollow, cylindrical body.

17. The pick of claim 16, wherein the tip is disposed at a peak of the bridge.

18. A pick for a musical instrument having strings, comprising:

a body having a proximal end and a distal end, wherein the body comprises a hollow, cylindrical body configured to fit over a fingertip of a user, the body further comprising a flex-relief cut-away extending from the proximal end to the distal end and a knuckle relief cut-away on the proximal end, and wherein the distal end comprises a bridge configured as a partial-ring attached to edge portions of the hollow, cylindrical body, wherein the bridge is oriented at a compound angle with respect to the body, the compound angle comprising a rotation angle, wherein the bridge is rotated about a longitudinal axis of the body, and a bend angle, wherein the bridge is bent about a lateral axis of the body; and a tip disposed on the distal end at a peak of the bridge, wherein the compound angle is configured to align the tip with the strings when the pick is used on the musical instrument.

19. The pick of claim 18, wherein the rotation angle measures from zero to ninety degrees and the bend angle is greater than zero degrees and less than or equal to ninety degrees.

20. A pick for a musical instrument having strings, comprising: a hollow, cylindrical body configured to fit over a fingertip of a user, wherein the body has a proximal end and a distal end, the body further comprising a flex relief cut-away extending from the proximal end to the distal end and a knuckle relief cut-away on the proximal end; a bridge configured as a partial ring attached to edge portions of the distal end of the hollow, cylindrical body; and a tip disposed at a peak of the bridge, wherein the tip is oriented at a compound angle with respect to the body, wherein the compound angle comprises a rotation angle wherein the tip is rotated about a longitudinal axis of the body, and a bend angle wherein the tip is bent about a lateral axis of the body.

21. The pick of claim 20, wherein the compound angle is configured to align the tip with the strings when the pick is used on the musical instrument.

22. The pick of claim 20, wherein the rotation angle measures from zero to ninety degrees and the bend angle is greater than zero degrees and less than or equal to ninety degrees.

* * * * *